US010102794B2

(12) United States Patent
Bower et al.

(10) Patent No.: US 10,102,794 B2
(45) Date of Patent: Oct. 16, 2018

(54) DISTRIBUTED CHARGE-PUMP POWER-SUPPLY SYSTEM

(71) Applicant: X-Celeprint Limited, Cork (IE)

(72) Inventors: Christopher Bower, Raleigh, NC (US); Matthew Meitl, Durham, NC (US); Robert R. Rotzoll, Colorado Springs, CO (US)

(73) Assignee: X-Celeprint Limited, Cork (IE)

( * ) Notice: Subject to any disclaimer, the term of this patent is extended or adjusted under 35 U.S.C. 154(b) by 433 days.

(21) Appl. No.: 14/833,852

(22) Filed: Aug. 24, 2015

(65) Prior Publication Data

US 2016/0365026 A1 Dec. 15, 2016

Related U.S. Application Data

(60) Provisional application No. 62/173,206, filed on Jun. 9, 2015.

(51) Int. Cl.

| | |
|---|---|
| ***G09G 3/32*** | (2016.01) |
| ***G09G 3/20*** | (2006.01) |
| ***H05B 33/08*** | (2006.01) |

(52) U.S. Cl.

CPC ..... *G09G 3/2096* (2013.01); *G09G 3/32* (2013.01); *H05B 33/0815* (2013.01); *H05B 33/0857* (2013.01); *G09G 2310/0289* (2013.01); *G09G 2330/02* (2013.01)

(58) Field of Classification Search

None

See application file for complete search history.

(56) References Cited

U.S. PATENT DOCUMENTS

| | | | |
|---|---|---|---|
| 5,621,555 | A | 4/1997 | Park |
| 5,815,303 | A | 9/1998 | Berlin |
| 6,278,242 | B1 | 8/2001 | Cok et al. |

(Continued)

FOREIGN PATENT DOCUMENTS

| | | |
|---|---|---|
| WO | WO-2008/103931 A2 | 8/2008 |
| WO | WO-2014/149864 A1 | 9/2014 |

OTHER PUBLICATIONS

Roscher, H., VCSEL Arrays with Redundant Pixel Designs for 10Gbits/s 2-D Space-Parallel MMF Transmission, Annual Report, optoelectronics Department, (2005).

(Continued)

*Primary Examiner* — Carl Adams

(74) *Attorney, Agent, or Firm* — William R. Haulbrook; Michael D. Schmitt; Choate, Hall & Stewart LLP

(57) ABSTRACT

A distributed charge-pump power-supply system includes a system substrate with a plurality of separate electronic elements spatially distributed over the system substrate. Each electronic element includes first and second sub-elements requiring first and second different operating voltage connections. A plurality of separate charge-pump circuits are also spatially distributed over the system substrate. Each charge-pump circuit has a common charge-pump power supply connection and provides the first and second voltage connection supplying operating electrical power to the first and second sub-elements. The electronic elements are arranged in groups of one or more electronic elements and the first and second voltage connections for each group are provided by a charge-pump circuit.

20 Claims, 15 Drawing Sheets

(56) References Cited

U.S. PATENT DOCUMENTS

| | | | |
|---|---|---|---|
| 6,577,367 | B2 | 6/2003 | Kim |
| 6,717,560 | B2 | 4/2004 | Cok et al. |
| 6,756,576 | B1 | 6/2004 | McElroy et al. |
| 6,933,532 | B2 | 8/2005 | Arnold et al. |
| 7,012,382 | B2 | 3/2006 | Cheang et al. |
| 7,129,457 | B2 | 10/2006 | McElroy et al. |
| 7,195,733 | B2 | 3/2007 | Rogers et al. |
| 7,288,753 | B2 | 10/2007 | Cok |
| 7,521,292 | B2 | 4/2009 | Rogers et al. |
| 7,557,367 | B2 | 7/2009 | Rogers et al. |
| 7,586,497 | B2 | 9/2009 | Boroson et al. |
| 7,622,367 | B1 | 11/2009 | Nuzzo et al. |
| 7,662,545 | B2 | 2/2010 | Nuzzo et al. |
| 7,704,684 | B2 | 4/2010 | Rogers et al. |
| 7,799,699 | B2 | 9/2010 | Nuzzo et al. |
| 7,816,856 | B2 | 10/2010 | Cok et al. |
| 7,893,612 | B2 | 2/2011 | Cok |
| 7,927,976 | B2 | 4/2011 | Menard |
| 7,932,123 | B2 | 4/2011 | Rogers et al. |
| 7,943,491 | B2 | 5/2011 | Nuzzo et al. |
| 7,972,875 | B2 | 7/2011 | Rogers et al. |
| 7,982,296 | B2 | 7/2011 | Nuzzo et al. |
| 7,999,454 | B2 | 8/2011 | Winters et al. |
| 8,029,139 | B2 | 10/2011 | Ellinger et al. |
| 8,039,847 | B2 | 10/2011 | Nuzzo et al. |
| 8,198,621 | B2 | 6/2012 | Rogers et al. |
| 8,207,547 | B2 | 6/2012 | Lin |
| 8,261,660 | B2 | 9/2012 | Menard |
| 8,334,545 | B2 | 12/2012 | Levermore et al. |
| 8,394,706 | B2 | 3/2013 | Nuzzo et al. |
| 8,440,546 | B2 | 5/2013 | Nuzzo et al. |
| 8,470,701 | B2 | 6/2013 | Rogers et al. |
| 8,502,192 | B2 | 8/2013 | Kwak et al. |
| 8,506,867 | B2 | 8/2013 | Menard |
| 8,664,699 | B2 | 3/2014 | Nuzzo et al. |
| 8,686,447 | B2 | 4/2014 | Tomoda et al. |
| 8,722,458 | B2 | 5/2014 | Rogers et al. |
| 8,754,396 | B2 | 6/2014 | Rogers et al. |
| 8,766,970 | B2 | 7/2014 | Chien et al. |
| 8,791,474 | B1 | 7/2014 | Bibl et al. |
| 8,794,501 | B2 | 8/2014 | Bibl et al. |
| 8,803,857 | B2 | 8/2014 | Cok |
| 8,817,369 | B2 | 8/2014 | Daiku |
| 8,854,294 | B2 | 10/2014 | Sakariya |
| 8,877,648 | B2 | 11/2014 | Bower et al. |
| 8,889,485 | B2 | 11/2014 | Bower |
| 8,895,406 | B2 | 11/2014 | Rogers et al. |
| 8,987,765 | B2 | 3/2015 | Bibl et al. |
| 2003/0201729 | A1* | 10/2003 | Kimura ..... G09G 3/3233 315/169.3 |
| 2005/0012739 | A1* | 1/2005 | Kamijo ..... G09G 3/3696 345/212 |
| 2006/0238465 | A1* | 10/2006 | Kurumisawa ..... G09G 3/3406 345/82 |
| 2009/0201231 | A1* | 8/2009 | Takahara ..... G09G 3/3233 345/76 |
| 2010/0207848 | A1* | 8/2010 | Cok ..... G09G 3/2085 345/76 |
| 2010/0248484 | A1 | 9/2010 | Bower et al. |
| 2012/0044273 | A1* | 2/2012 | Park ..... G09G 3/20 345/690 |
| 2012/0228669 | A1 | 9/2012 | Bower et al. |
| 2012/0314388 | A1 | 12/2012 | Bower et al. |
| 2013/0069275 | A1 | 3/2013 | Menard et al. |
| 2013/0088416 | A1 | 4/2013 | Smith et al. |
| 2013/0196474 | A1 | 8/2013 | Meitl et al. |
| 2013/0207964 | A1 | 8/2013 | Fleck et al. |
| 2013/0221355 | A1 | 8/2013 | Bower et al. |
| 2013/0273695 | A1 | 10/2013 | Menard et al. |
| 2014/0104243 | A1 | 4/2014 | Sakariya et al. |
| 2014/0264763 | A1 | 9/2014 | Meitl et al. |
| 2014/0267683 | A1 | 9/2014 | Bibl et al. |
| 2014/0367633 | A1 | 12/2014 | Bibl et al. |
| 2015/0135525 | A1 | 5/2015 | Bower |
| 2015/0137153 | A1 | 5/2015 | Bibl et al. |

OTHER PUBLICATIONS

Yaniv et al., A 640 x 480 Pixel Computer Display Using Pin Diodes with Device Redundancy, 1988 International Display Research Conference, IEEE, CH-2678-1/88:152-154 (1988).

* cited by examiner

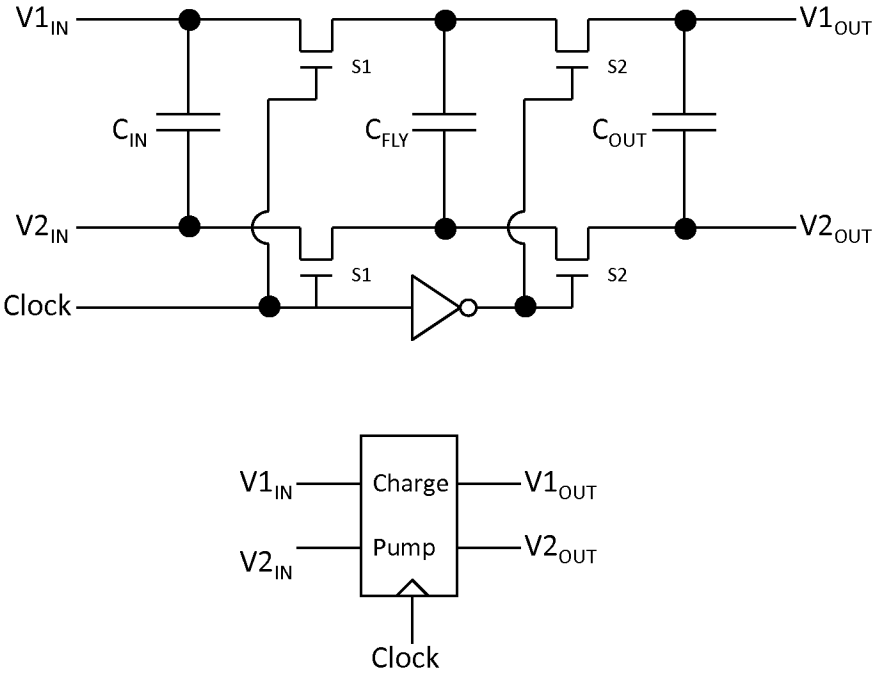
*FIG. 16 – Prior Art*

DISTRIBUTED CHARGE-PUMP POWER-SUPPLY SYSTEM

PRIORITY APPLICATION

This application claims priority to and the benefit of U.S. Provisional Patent Application No. 62/173,206, filed Jun. 9, 2015, titled "Distributed Charge-Pump Power-Supply System," the content of which is incorporated by reference herein in its entirety.

FIELD OF THE INVENTION

The present invention relates to a spatially distributed charge-pump power-supply system having a plurality of separate charge-pump circuits providing a variety of different power supplies to a corresponding variety of spatially distributed electronic elements.

BACKGROUND OF THE INVENTION

Flat-panel displays are widely used in conjunction with computing devices, in portable devices, and for entertainment devices such as televisions. Such displays typically employ a plurality of pixels distributed over a display substrate to display images, graphics, or text. For example, liquid crystal displays (LCDs) employ liquid crystals to block or transmit light from a backlight behind the liquid crystals and organic light-emitting diode (OLED) displays rely on passing current through a layer of organic material that glows in response to the current. In recent years, low-resolution, high-brightness outdoor displays using inorganic light-emitting diodes (LEDs) have become popular, especially for advertising and in sporting venues.

Color pixels are provided in LCDs by color filters used to individually filter the light passing through each light-emitting element of the array of liquid crystals. All of the liquid crystals can be identical and enabled with a common power supply connection. White OLED display also use color filters and all of the OLED pixels are similarly identical and enabled with a common power supply. In contrast, color pixels are provided in RGB OLEDs by providing different organic materials that each emit different colors of light. These different organic materials can also be enabled with a common power supply.

In contrast, inorganic LEDs that emit different colors of light are often constructed in different materials, have different threshold voltages and current response, and require different power supplies. These different power supplies are provided externally and then distributed over the substrate or structure on or in which the array of inorganic pixels is located. Thus, for a three-color inorganic LED display, three different external power supplies capable of supporting the pixels associated with each color are needed together with sets of power lines that are routed and connected over the display area. Such connections can reduce emission area (aperture ratio), increase the cost of materials, and increase the number of interconnections, leading to reduced yields. Furthermore, batches of inorganic LEDs, even when made of the same materials in the same processes, tend to have a variable color output, a variable turn-on voltage, a variable resistance, and a variable current-response curve. Thus, when connected to a common power supply, the different inorganic LEDs will have different efficiencies and performance and the common-power circuits providing electricity to the different inorganic LEDs will have variable losses.

Integrated circuits of the prior art sometimes provide an on-chip power-conversion circuit to provide an additional power supply having a different voltage than the other circuitry of the integrated circuit. An example of one such power-conversion circuit is a charge pump, illustrated in FIG. 16. As shown in FIG. 16, an example prior-art charge-pump circuit includes two input voltage lines (e.g. power and ground) connected across an input capacitor $C_{IN}$. A switch ($S_1$) is connected in each of the input voltage lines and another capacitor, conventionally called the flying capacitor $C_{FLY}$, is connected across the input lines after the switches $S_1$. Another set of switches ($S_2$) is connected in each of the input voltage lines after the first switches $S_1$ and the flying capacitor and are connected to the output voltage lines and the terminals of an output capacitor $C_{OUT}$. Switches $S_1$ and $S_2$ are alternately operated, for example with a clock signal and an inverter, as shown. In operation over time the charge-pump circuit tends to provide the same voltage across the input lines and the output lines, as charge is pumped from the first capacitor to the flying capacitor to the output capacitor. By providing one or more of the charge-pump circuits with common input voltages and different connections between the output and input lines a variety of output voltages are achieved. For example, by connecting the $\mathbf{V2}_{OUT}$ line to the $\mathbf{V1}_{IN}$ line, the voltage across the $\mathbf{V1}_{OUT}$ line and the $\mathbf{V2}_{IN}$ line is twice that of the voltage across the $\mathbf{V1}_{IN}$ and $\mathbf{V2}_{IN}$ lines. The lower illustration of FIG. 16 is a representation of any of a variety of charge-pump circuits such as that of the upper illustration. Various charge-pump circuits connected in various ways provide a wide variety of different power and current sources.

Because of the variability in micro-LED (μLED) materials and manufacturing processes, different μLEDs, even when made in similar materials, have different performances and losses in the circuits providing power to the different μLEDs. μLEDs made in different materials have even greater inefficiencies when provided with a common power source. Furthermore, these issues are exacerbated in μLEDs since the variability of materials in a source semiconductor wafer is much greater on a smaller scale than on a larger scale.

There is a need, therefore, for improvements in power circuits for arrays of electronic elements such as inorganic μLEDs including different materials.

SUMMARY OF THE INVENTION

The present invention relates to a spatially distributed charge-pump power-supply system having a plurality of separate charge-pump circuits providing a variety of different power supplies to a corresponding variety of spatially distributed electronic elements. Because of the variability in performance and requirements of different electronic elements, such as μLEDs, a single power supply is unable to provide suitable power sources or is inefficient in operation when applied to such variable devices.

The present invention addresses this problem with a distributed power supply system that uses charge-pump circuits distributed and interspersed among the various electronic elements. The various electronic elements are spatially distributed over a substrate and the charge-pump circuits are likewise spatially distributed over the substrate for example adjacent to the electronic elements, adjacent to groups of elements, or spatially located between electronic elements in a group of electronic elements. A single charge-pump circuit can be associated with a single electronic element, with groups of the same electronic elements, or with groups of different electronic elements. In some embodiments, different charge-pump circuits are used for different electronic elements. Different numbers of different charge-pump circuits than the number of electronic elements can be used.

In an embodiment, the electronic elements include different μLEDs that emit different colors of light, for example red, green, and blue. The different μLEDs are made with different materials and have different electrical requirements. Different charge-pump circuits are provided for the different μLEDs and spatially distributed with and among the μLEDs over a substrate. The different charge-pump circuits can be arranged over the substrate with pixel groups that each include one each of the different μLEDs. Common power supply and ground electrical connections are provided to the different charge-pump circuits.

The distributed charge-pump power-supply system of the present invention provides increased electrical efficiency, aperture ratio, and yields when provided over a substrate and used to drive an array of different electronic elements such as μLEDs emitting different colors of light.

In one aspect, the disclosed technology includes a distributed charge-pump power-supply system, including: a system substrate; a plurality of separate electronic elements spatially distributed over the system substrate, each electronic element including a first sub-element requiring a first voltage connection supplying operating electrical power at a first voltage and a second sub-element requiring a second voltage connection supplying operating electrical power at a second voltage, the first voltage different from the second voltage; and a plurality of separate charge-pump circuits spatially distributed over the system substrate, each charge-pump circuit having a common charge-pump power supply connection and providing the first voltage connection supplying operating electrical power at the first voltage and the second voltage connection supplying operating electrical power at the second voltage, wherein the electronic elements are arranged in groups and the first and second voltage connections for each group are provided by a charge-pump circuit of the plurality of charge-pump circuits.

In certain embodiments, the sub-elements are inorganic light-emitting diodes.

In certain embodiments, the electronic elements are multi-color pixels and the sub-elements are different light emitters each emitting a different color of light.

In certain embodiments, each electronic element further comprises a third sub-element requiring a third voltage connection supplying operating electrical power at a third voltage, the third voltage different from the first voltage and different from the second voltage.

In certain embodiments, the first, second, and third sub-elements are different inorganic light-emitting diodes that emit light of different colors.

In certain embodiments, the different colors are red, green, and blue.

In certain embodiments, one or more groups comprise only one electronic element.

In certain embodiments, one or more groups comprise two or more electronic elements.

In certain embodiments, the charge-pump circuit comprises a first charge pump supplying the first voltage and a second charge pump supplying the second voltage, the first charge pump separate from the second charge pump.

In certain embodiments, the charge-pump circuit comprises a first charge pump supplying the first voltage and a second charge pump supplying the second voltage, the first charge pump sharing a portion of the charge-pump circuit with the second charge pump.

In certain embodiments, the distributed charge-pump power-supply system includes a control circuit for controlling the electronic element and wherein the control circuit is provided in a first integrated circuit and the charge-pump circuit is at least partly provided in the first integrated circuit.

In certain embodiments, the distributed charge-pump power-supply system includes a control circuit for controlling the electronic element and wherein the control circuit is provided in a first integrated circuit and the charge-pump circuit is at least partly provided in a second integrated circuit that is different from the first integrated circuit.

In certain embodiments, the electronic element is provided in a single integrated circuit.

In certain embodiments, two or more sub-elements of a common electronic element are provided in separate integrated circuits.

In certain embodiments, the charge-pump circuit is provided in an integrated circuit.

In certain embodiments, the charge-pump circuit is provided in two or more integrated circuits.

In certain embodiments, a portion of the charge-pump circuit is provided in a first integrated circuit and portions of the charge-pump circuit are each provided in a plurality of second integrated circuits.

In certain embodiments, the second integrated circuits are spatially separated over the system substrate.

In certain embodiments, the electronic elements are provided on element substrates separate from the system substrate.

In certain embodiments, the charge-pump circuit is provided on the element substrate.

In certain embodiments, the distributed charge-pump power-supply system includes a clock generated within the charge-pump circuit.

In certain embodiments, the charge-pump circuit is spatially located between the sub-elements that receive power from the charge-pump circuit or is spatially located between the electronic elements in a group of two or more electronic elements that receive power from the charge-pump circuit.

In certain embodiments, the sub-elements are memory storage devices, static random access memory devices, dynamic random access memory devices, non-volatile memory device, or volatile memory devices.

In certain embodiments, the electronic elements are memory storage devices, non-volatile or volatile memories, or lookup tables.

In another aspect, the disclosed technology includes a display having a distributed charge-pump power-supply system, including: a system substrate; a plurality of multi-color pixels spatially distributed over the system substrate, each multi-color pixel including a first inorganic light-emitting diode requiring a first voltage connection supplying operating electrical power at a first voltage and a second inorganic light-emitting diode requiring a second voltage connection supplying operating electrical power at a second voltage, the first voltage different from the second voltage; and a plurality of separate charge-pump circuits spatially distributed over the system substrate, each charge-pump circuit having a common charge-pump power supply connection and providing the first voltage connection supplying operating electrical power at the first voltage and the second voltage connection supplying operating electrical power at the second voltage, wherein the first and second inorganic light-emitting diodes of the multi-color pixels are arranged in groups and the first and second voltage connections for each group are provided by a charge-pump circuit of the plurality of charge-pump circuits.

In certain embodiments, any of the inorganic light-emitting diodes and the charge-pump circuit are provided on element substrates separate from the system substrate and are tiled over the system substrate to form an array of the inorganic light-emitting diodes.

In certain embodiments, each multi-color pixel comprises a third inorganic light-emitting diode requiring a third voltage connection supplying operating electrical power at a third voltage, the third voltage different from the first voltage and the second voltage; and each charge-pump circuit providing the third voltage connection supplying operating electrical power at the third voltage, wherein the first, second, and third inorganic light-emitting diodes of the multi-color pixels are arranged in groups and the first, second, and third voltage connections for each group are provided by a charge-pump circuit of the plurality of charge-pump circuits.

In certain embodiments, each of the plurality of inorganic micro light-emitting diodes has a width from 2 to 5 μm, 5 to 10 μm, 10 to 20 μm, or 20 to 50 μm.

In certain embodiments, each of the plurality of inorganic micro light-emitting diodes has a length from 2 to 5 μm, 5 to 10 μm, 10 to 20 μm, or 20 to 50 μm.

In certain embodiments, each of the plurality of inorganic micro light-emitting diodes has a height from 2 to 5 μm, 4 to 10 μm, 10 to 20 μm, or 20 to 50 μm.

In certain embodiments, the display substrate is a polymer, plastic, resin, polyimide, polyethylene naphthalate, polyethylene terephthalate, metal, metal foil, glass, a semiconductor, or sapphire.

In certain embodiments, the display substrate is flexible.

In certain embodiments, each light emitter of the plurality of inorganic light emitters has a light-emissive area and wherein the combined light-emissive areas of the plurality of inorganic light emitters is less than or equal to one eighth, one tenth, one twentieth, one fiftieth, one hundredth, one two-hundredth, one five-hundredth, one thousandth, or one ten-thousandth of the light-absorbing material area.

In certain embodiments, the display substrate has a transparency greater than or equal to 50%, 80%, 90%, or 95% for visible light.

BRIEF DESCRIPTION OF THE DRAWINGS

The foregoing and other objects, aspects, features, and advantages of the present disclosure will become more apparent and better understood by referring to the following description taken in conjunction with the accompanying drawings, in which:

FIG. 16 is a prior-art schematic of a charge pump.

Figure 1:
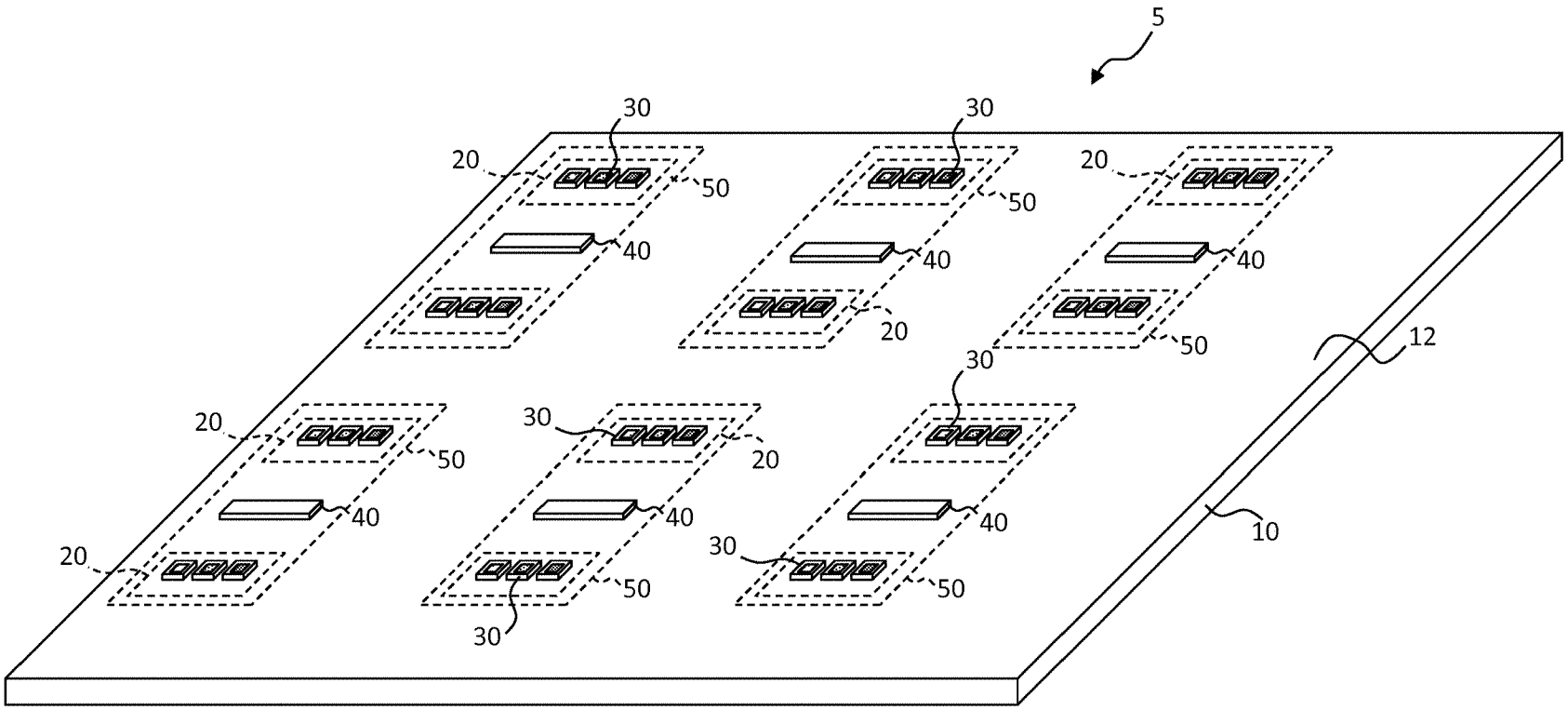
FIG. 1 is a perspective of an embodiment of the present invention.

The features and advantages of the present disclosure will become more apparent from the detailed description set forth below when taken in conjunction with the drawings, in which like reference characters identify corresponding elements throughout. In the drawings, like reference numbers generally indicate identical, functionally similar, and/or structurally similar elements. The figures are not drawn to scale since the variation in size of various elements in the Figures is too great to permit depiction to scale.

DETAILED DESCRIPTION OF THE INVENTION

Figure 2:
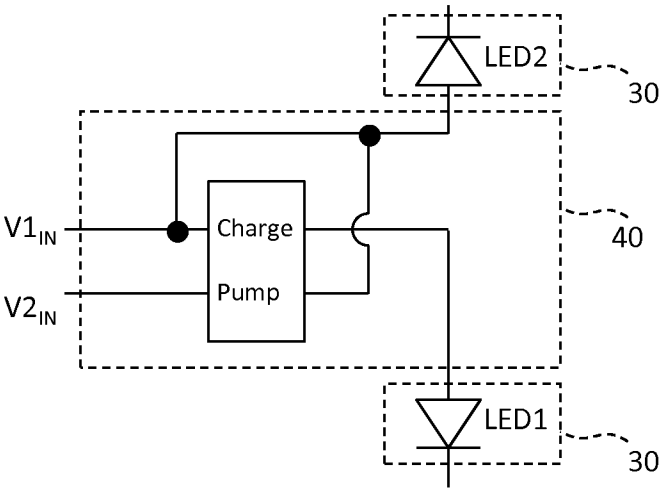
FIG. 2 is a perspective of another embodiment of the present invention.

Referring to the perspectives of FIGS. 1 and 2, in an embodiment of the present invention, a distributed charge-pump power-supply system 5 includes a system substrate 10. A plurality of separate electronic elements 20 are spatially distributed over the system substrate 10. In an embodiment, the electronic elements 20 are arranged in a regular array. In an alternative embodiment the electronic elements 20 are not arranged in a regular array. Each electronic element 20 includes two or more sub-elements 30, for example a first sub-element 30A requiring a first voltage connection supplying operating electrical power at a first voltage and a second sub-element 30B requiring a second voltage connection supplying operating electrical power at a second voltage, the first voltage different from the second voltage. In a further embodiment of the present invention and as illustrated in FIGS. 1 and 2, the distributed charge-pump power-supply system 5 further includes a third sub-element 30C requiring a third voltage connection supplying operating electrical power at a third voltage, the third voltage different from the first voltage and different from the second voltage. Thus, the electronic elements 20 and sub-elements 30 require power supplied at two or more different voltages to operate. For clarity, wires electrically connecting the sub-elements 30 to the charge-pump circuit 40 are omitted but can be used to supply the different voltages from the charge-pump circuit 40 to the sub-elements 30. Suitable wires, for example including metal, can be formed photolithographically over the system substrate 10 and electronic elements 20.

A plurality of separate charge-pump circuits 40 are spatially distributed over the system substrate 10. In an embodiment, the charge-pump circuits 40 are spatially interspersed between the electronic elements 20 on or over the system substrate 10. The charge-pump circuits 40 can be arranged in a regular array or not. In one embodiment and as shown in FIG. 1, a separate charge-pump circuit 40 is provided for each of a group 50 of electronic elements 20 and the electronic elements 20 in the group 50 share the power provided by the corresponding charge-pump circuit 40. In the FIG. 1 illustration, two electronic elements 20 are in a group 50 associated with the charge-pump circuit 40. In another embodiment as shown in FIG. 2, a separate charge-pump circuit 40 is provided for each electronic element 20 so that the group 50 includes only a single electronic element 20. Each charge-pump circuit 40 has a common charge-pump power supply connection and provides both the first voltage connection supplying operating electrical power at the first voltage and the second voltage connection supplying operating electrical power at the second voltage. Thus, the charge-pump circuit 40 of the plurality of charge-pump circuits 40 provides the first and second voltage connections for each group 50 of electronic elements 20.

As explicitly intended herein, the groups 50 of electronic elements 20 can include only one electronic element 20 (as shown in FIG. 2) or can include more than one electronic element 20, for example two electronic elements 20 (as shown in FIG. 1), four electronic elements 20, or nine electronic elements 20. In an embodiment, the charge-pump circuit 40 is spatially located between the sub-elements 30 in an electronic element 20 that receive power from the charge-pump circuit 40 or is spatially located between the electronic elements 20 in a group 50 of two or more electronic elements 20 that receive power from the charge-pump circuit 40. Alternatively, the charge-pump circuits 40 are spatially located between groups 50 of two electronic elements 20. In an embodiment, the charge-pump circuit 40 is provided in at least a portion of an integrated circuit, as shown in FIG. 1. In a further embodiment, the clocks of each of the charge-pump circuits 40 are electrically connected in common, or the clocks of charge-pump circuits 40 in a group of charge-pump circuits 40 are electrically connected in common. The clocks of different groups of charge-pump circuits 40 can be out of phase to reduce instantaneous current flow in the clock conductors.

In one embodiment, the sub-elements 30 are inorganic light-emitting diodes. For example, the electronic elements 20 are multi-color pixels and the sub-elements 30A, 30B, 30C are different light emitters each emitting a different color of light, such as red, green, or blue light. In a different example, the electronic elements 20 could include four different light-emitting diodes emitting, red, green, blue, and yellow light. In other embodiments, the electronic elements are memory storage devices, non-volatile or volatile memories and can store various types of data, for example LUT calibration data for pixels. The electronic elements 20 can include disparate types of electronic devices. For example, the sub-elements 30 can be different types of memory storage devices, such as static or dynamic random access memories, non-volatile memories, or volatile memories.

Figure 3:
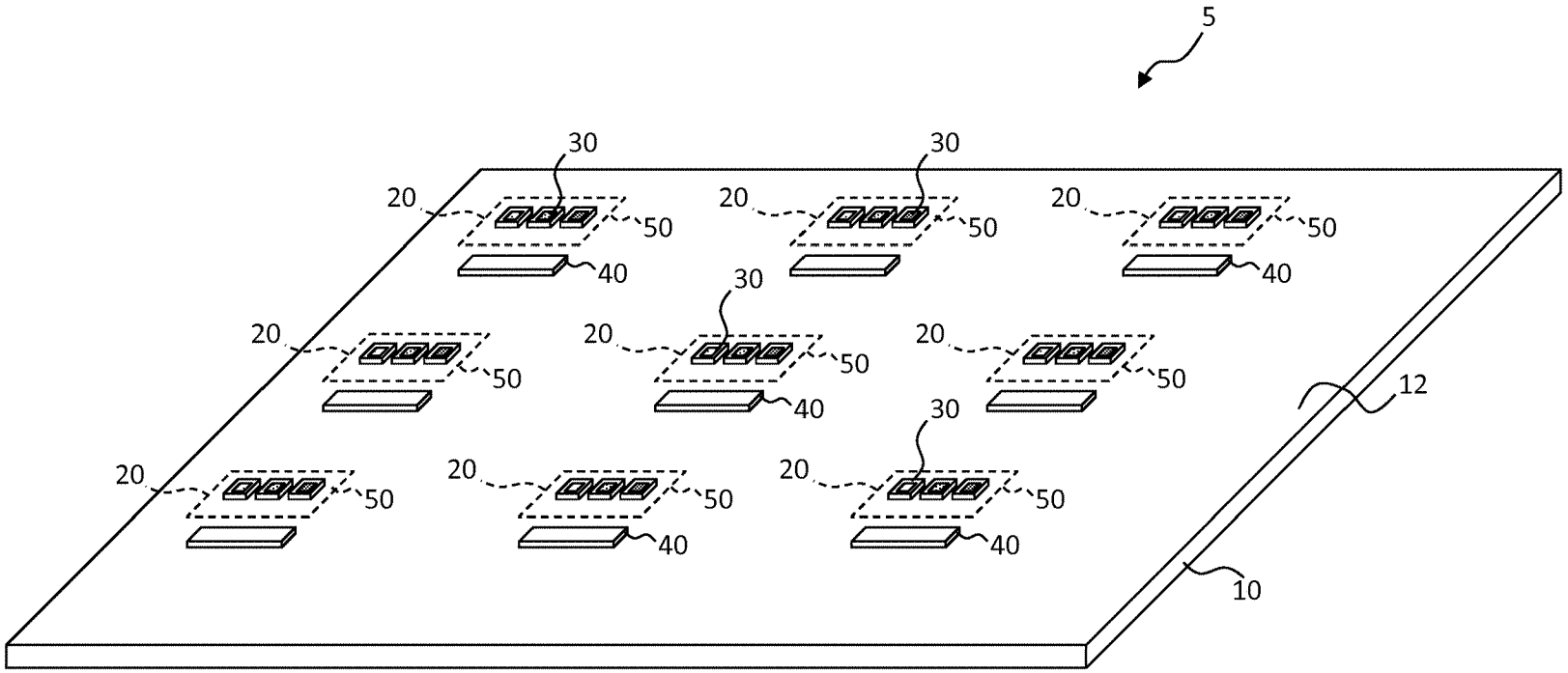
FIGS. 3-5 are circuit schematics in accordance with various embodiments of the present invention.
Figure 4:
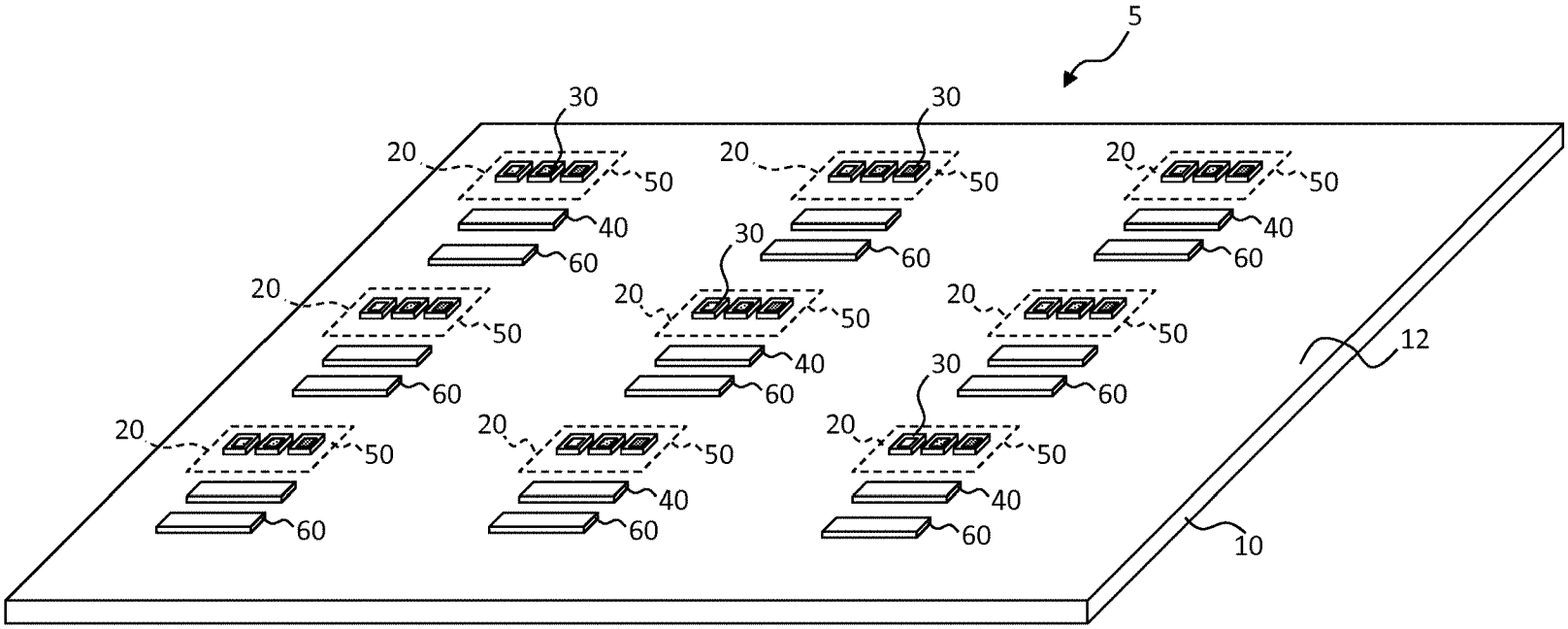
Figure 5:
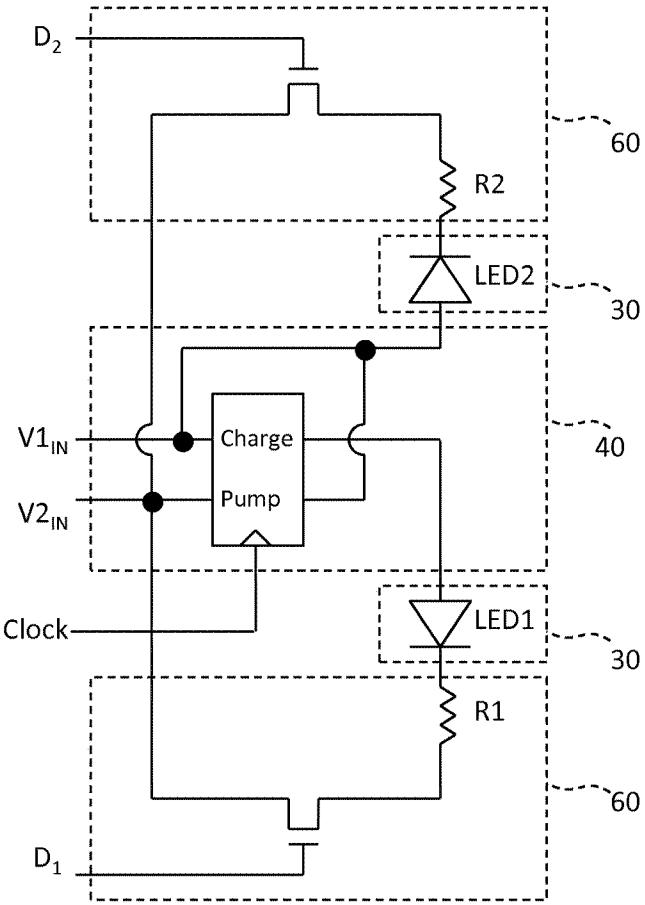

Referring to FIGS. 3 and 4, a single charge-pump circuit 40 of the distributed charge-pump power-supply system 5 can be connected to supply multiple individual and separate first and second voltages. As shown in FIGS. 3 and 4, the charge-pump circuit 40 has two different input voltage lines, $V1_{IN}$ and $V2_{IN}$. The outputs of the charge-pump circuit 40 are connected in such a way as to provide different relative voltages to two different sub-elements 30, for example light-emitting diode 1 (LED1) and light-emitting diode 2 (LED2). FIG. 3 and FIG. 4 are connected as illustrative examples of charge-pump circuits 40 that produce different relative voltage differences. In another embodiment illustrated in FIG. 5, the charge-pump circuits 40 of the distributed charge-pump power-supply system 5 can include multiple charge pumps such as first charge pump 42 and second charge pump 44 that share portions of a circuit, for example a clock oscillator, or are interconnected together to supply the different first, second, and third voltages required for the different sub-elements 30, illustrated as LED1, LED2, and LED3. In yet another embodiment, the charge-pump circuits 40 of the distributed charge-pump power-supply system 5 can include multiple individual and separate charge pumps, for example a first charge pump 42 supplying the first voltage and a second charge pump 44 supplying the second voltage.

In an embodiment, the electronic element 20 is provided in a single integrated circuit, is partly provided in a single integrated circuit or, alternatively and as shown in FIGS. 1 and 2, the sub-elements 30 of the electronic element 20 are provided in separate integrated circuits.

In another embodiment, the charge-pump circuit 40 is provided in two or more integrated circuits. For example, if the charge-pump circuit 40 includes multiple charge pumps that share portions of a circuit, the shared portion can be provided in one integrated circuit and the other portions that are not shared can be provided in a separate integrated circuit or in a plurality of separate integrated circuits. In a further embodiment, the other portions that are not shared can each be provided in a separate integrated circuit and the separate integrated circuits located in spatially different locations distributed over the system substrate 10, for example, spatially adjacent to the sub-elements 30 that receive their power from the distributed integrated circuits. In such an embodiment, the charge-pump circuit 40 includes an integrated circuit providing common circuitry and multiple distributed integrated circuits providing circuitry specific to one or more of the sub-elements 30.

Figure 6:
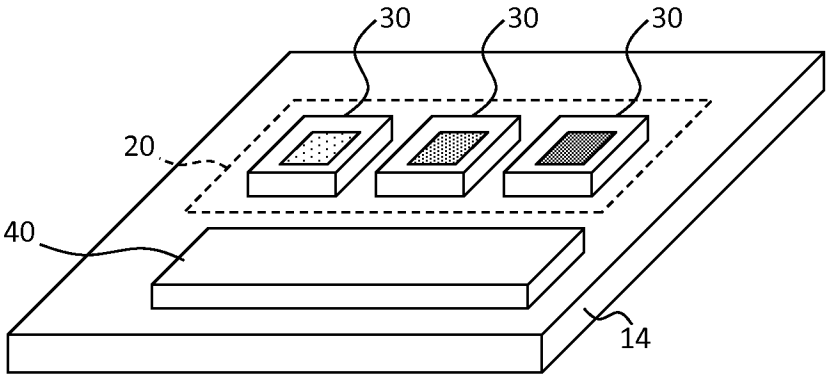
FIG. 6 is a perspective of a different embodiment of the present invention.

The distributed charge-pump power-supply system 5 of the present invention can include a control circuit 60 for controlling the electronic element 20, as shown in FIG. 6. Referring to FIG. 6, a control circuit 60 is spatially associated with each charge-pump circuit 40, a single electronic element 20 forming a group 50, and three sub-elements 30 in the single electronic element 20. In an embodiment, the control circuit 60 is provided in an integrated circuit separate and different from the charge-pump circuit 40 provided in a separate integrated circuit. In other embodiments, the control circuit 60 and the charge-pump circuit 40 are provided in a common integrated circuit, share portions of an integrated circuit, or are partially provided in a common integrated circuit. The charge-pump circuit 40 can provide power to the control circuit 60.

Figure 7:
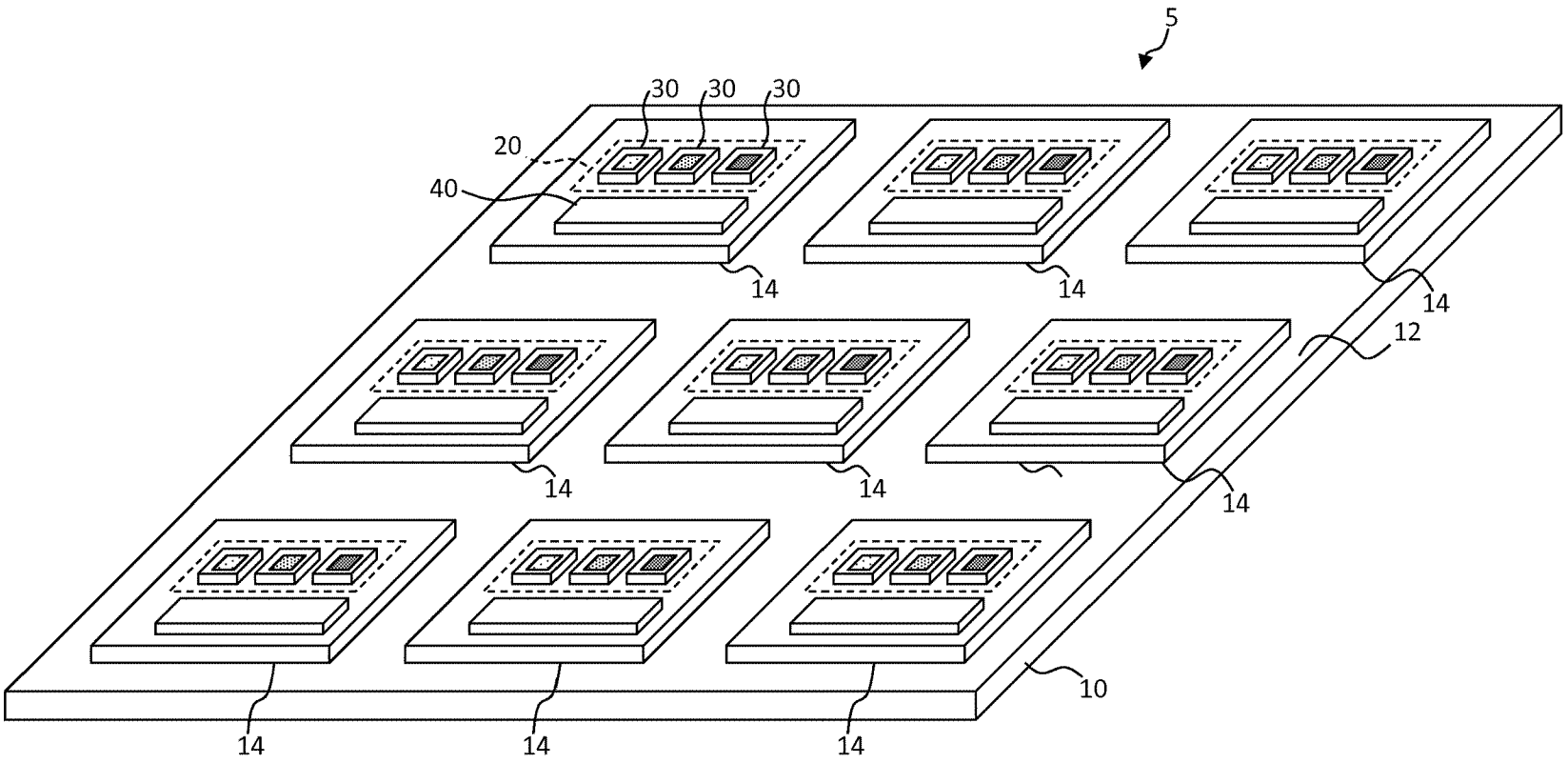
FIG. 7 is a circuit schematic with electronic control elements in accordance with embodiments of the present invention.

Referring to FIG. 7, the control circuit 60 and charge-pump circuit 40 are schematically illustrated (with two sub-elements 30, LED1 and LED2). As shown in FIG. 7, the charge-pump circuit 40 is interconnected to provide two different voltage levels suitable for providing power through different voltage connections to each of LED1 and LED2. A clock is illustrated to control the charge pump process and, in an embodiment, is generated within the charge-pump circuit 40, for example with an oscillator. A control circuit 60 includes a resistor R1 for LED1 and resistor R2 for LED2 to limit the current that can flow through the light-emitting diodes. A transistor T1 switches the current through LED1 and a transistor T2 switches the current through LED2 in response to control signals D1 and D2, respectively. Transistors T1 and T2 can control the timing and the amount of current supplied to LED1 and LED2, respectively, for example as is useful for light-emitting elements emitting differently colored light in a display.

Figure 8:
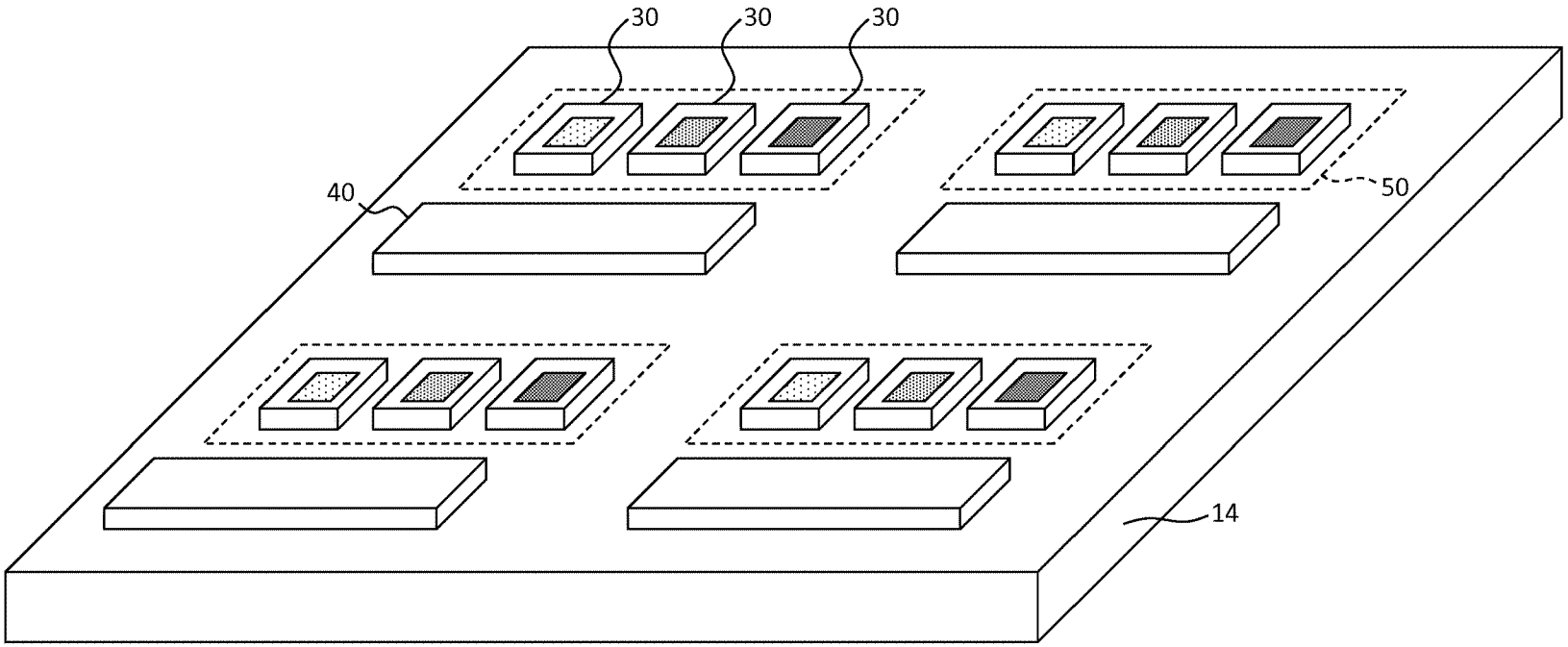
FIG. 8 is a perspective of an element substrate in accordance with embodiments of the present invention.
Figure 9:
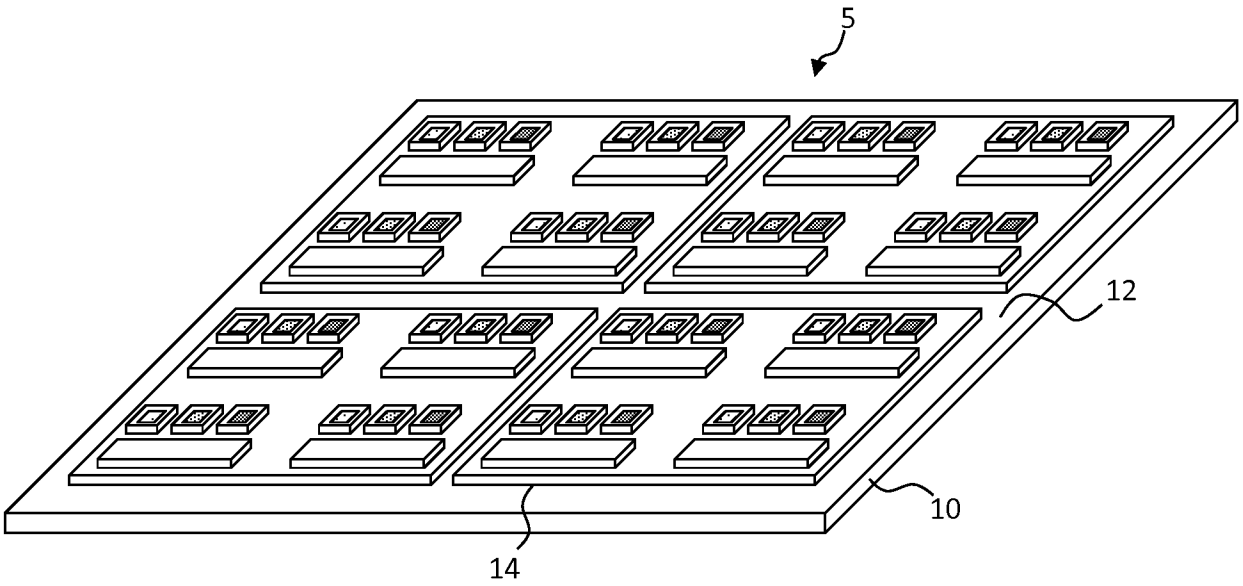
FIG. 9 is a perspective of an embodiment of the present invention having element substrates corresponding to FIG. 8.

Referring next to FIG. 8, in another embodiment of the present invention, one or more of the electronic elements 20 are provided on one or more element substrates 14 separate from the system substrate 10. As illustrated, the electronic elements 20 include three sub-elements 30, for example three different LEDs. The element substrates 14 can be made of different materials, be processed differently at different times and places under different conditions, or have a different size than the system substrate 10. In various embodiments, the electronic element 20, one or more of the sub-elements 30, or the charge-pump circuit 40, or some or all of these elements is provided on the element substrate 14. The element substrates 14 can be daughter cards that are mounted on the system substrate 10, or can form tiles with substrates separate from the system substrate 10 that are replicated and mounted on the system substrate 10, as shown in FIG. 9. Tiles or daughter cards can be mounted in a variety of ways, for example using solder connections or connectors. As intended herein, electronic elements 20 and sub-elements 30 are distributed over the system substrate 10 if they are located directly on the system substrate 10 (as in FIG. 1). They are also distributed over the system substrate 10 if they are located on element substrates 14 that are mounted on the system substrate 10, for example with daughter cards or tile substrates (as in FIG. 9). A further discussion of utilizing element substrates 14 in a display can be found in U.S. patent application Ser. No. 14/822,868 filed Aug. 10, 2015, entitled Compound Micro-Assembly Strategies and Devices, the contents of which are incorporated by reference herein in its entirety.

Figure 10:
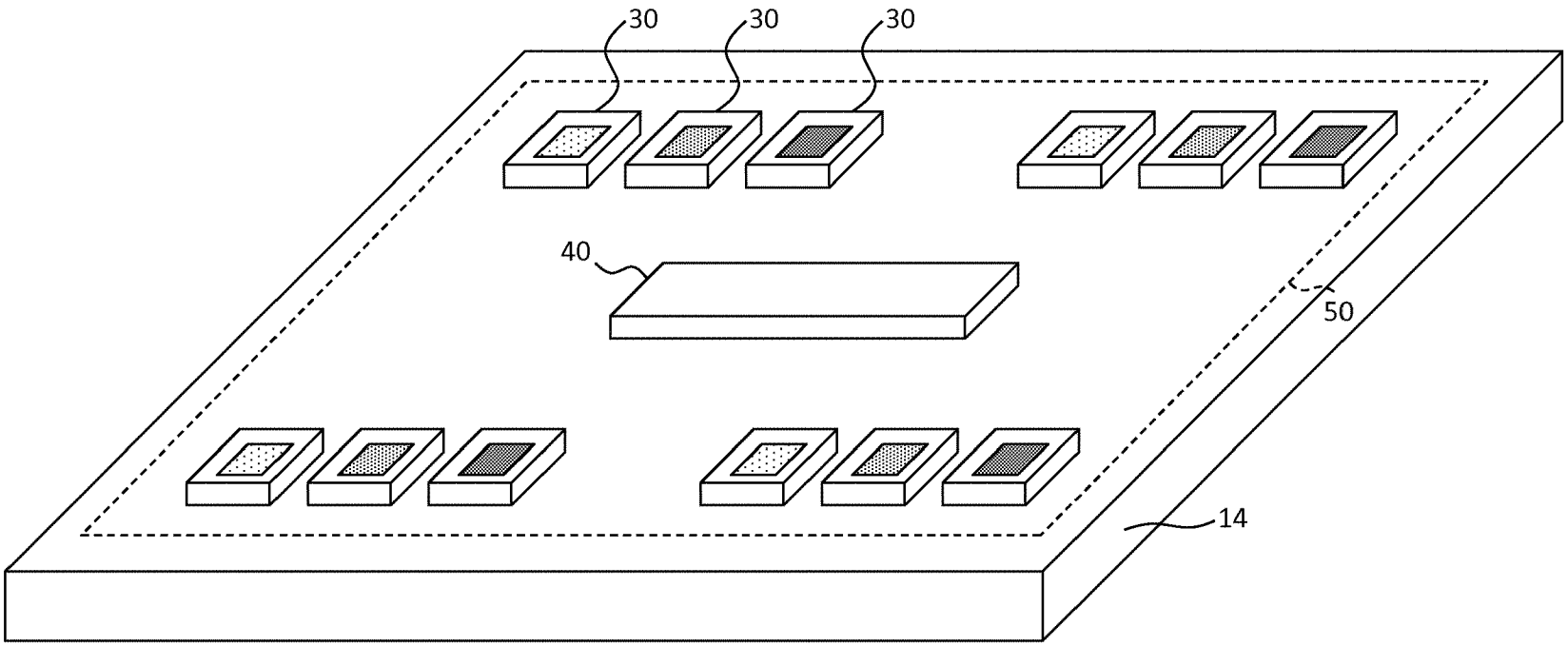
FIG. 10 is another perspective of an element substrate in accordance with another embodiment of the present invention.
Figure 11:
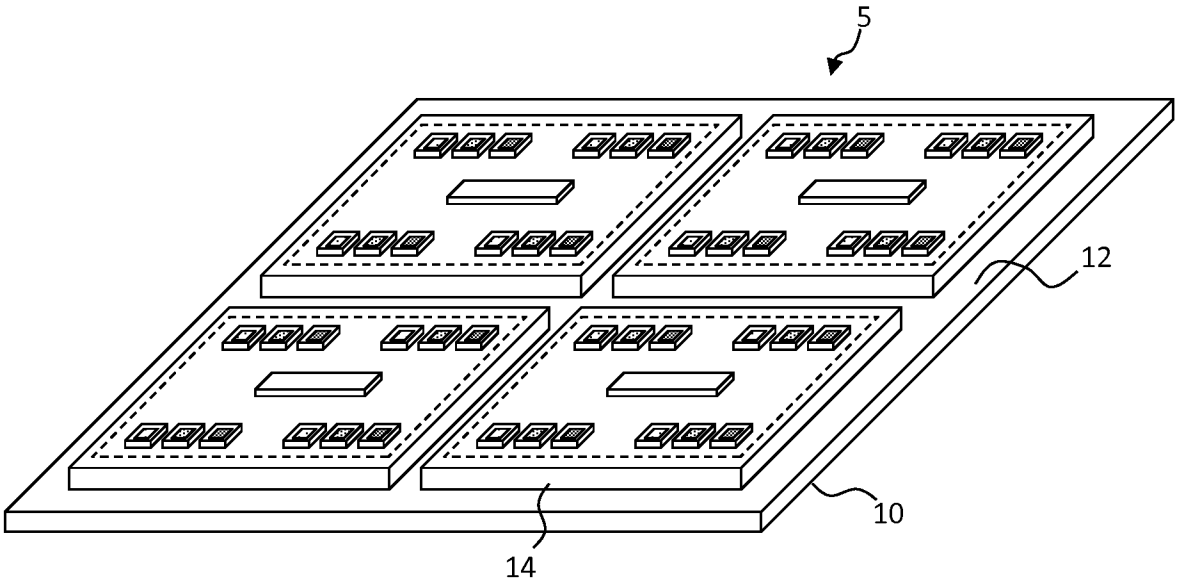
FIG. 11 is a perspective of another embodiment of the present invention having element substrates corresponding to FIG. 10.
Figure 13:
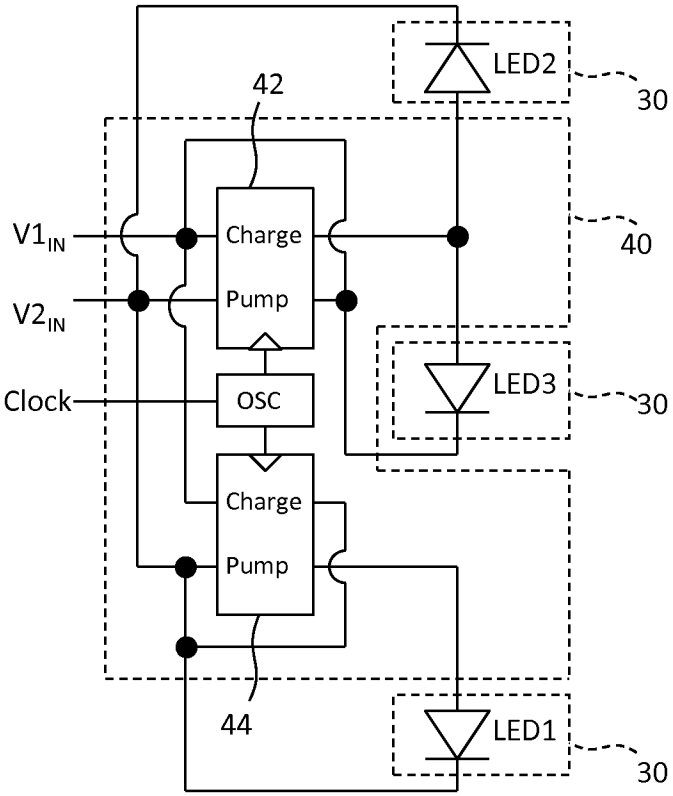
FIG. 13 is a perspective of another embodiment of the present invention having element substrates corresponding to FIG. 12.
Figure 12:
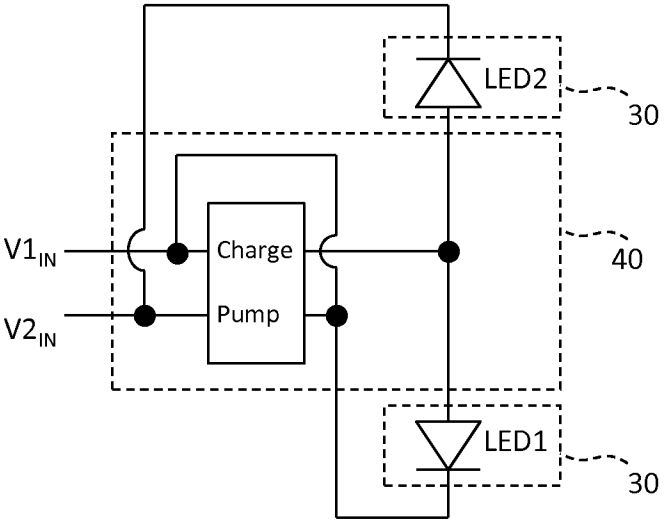
FIG. 12 is a perspective of a group and charge-pump circuit in accordance with an embodiment of the present invention.

Referring to the embodiment of FIG. 10, a single element substrate 14 supports a plurality of separate electronic elements 20 with sub-elements 30 and charge-pump circuits 40. FIG. 11 illustrates a distributed charge-pump power-supply system 5 having the substrate 10 with four tiled element substrates 14 on the system substrate surface 12 to form a four-by-four array of electronic elements 20, for example a four-by-four array of multi-color pixels each having three differently colored LEDs. FIG. 12 illustrates an alternative element substrate 14 with four electronic elements 20 each having three sub-elements 30 in a group 50 with a common charge-pump circuit 40 and FIG. 13 shows a tiled arrangement of the element substrates 14 on the system substrate 10 to form the distributed charge-pump power-supply system 5.

As with FIGS. 1 and 2, for clarity FIGS. 6, and 8-13 omit the wires, for example including metal, that electrically connect the sub-elements 30, the charge-pump circuits 40, and any control circuits 60 to each other or to external circuitry such as controllers.

In an embodiment of the present invention, a display having a distributed charge-pump power-supply system 5 includes a system substrate 10 and a plurality of electronic elements 20 that are multi-color pixels spatially distributed over the system substrate 10. Each multi-color pixel includes sub-elements 30 such as a first inorganic light-emitting diode requiring a first voltage connection supplying operating electrical power at a first voltage and a second inorganic light-emitting diode requiring a second voltage connection supplying operating electrical power at a second voltage different from the first voltage. A plurality of separate charge-pump circuits 40 are spatially distributed over the system substrate 10. The charge-pump circuits 40 can be interspersed between the multi-color pixels. Each charge-pump circuit 40 has a common charge-pump power supply connection and provides the first voltage connection supplying operating electrical power at the first voltage and the second voltage connection supplying operating electrical power at the second voltage.

The first and second inorganic light-emitting diodes of the multi-color pixels are arranged in groups 50, for example pixel groups, and the first and second voltage connections for each pixel group 50 are provided by a charge-pump circuit 40 of the plurality of charge-pump circuits 40. The groups 50 can include only one pixel. Alternatively, the groups 50 can include two, four, or more pixels. Any of the inorganic light-emitting diodes and the charge-pump circuit 40 can be provided on element substrates 14 separate from the system substrate 10 and are tiled over the system substrate 10 to form an array of the inorganic light-emitting diodes in the display. A discussion of micro-LEDs and micro-LED displays can be found in U.S. patent application Ser. No. 14/743,981, filed Jun. 18, 2015, entitled Micro Assembled Micro LED Displays and Lighting Elements, which is hereby incorporated by reference in its entirety.

Figure 14:
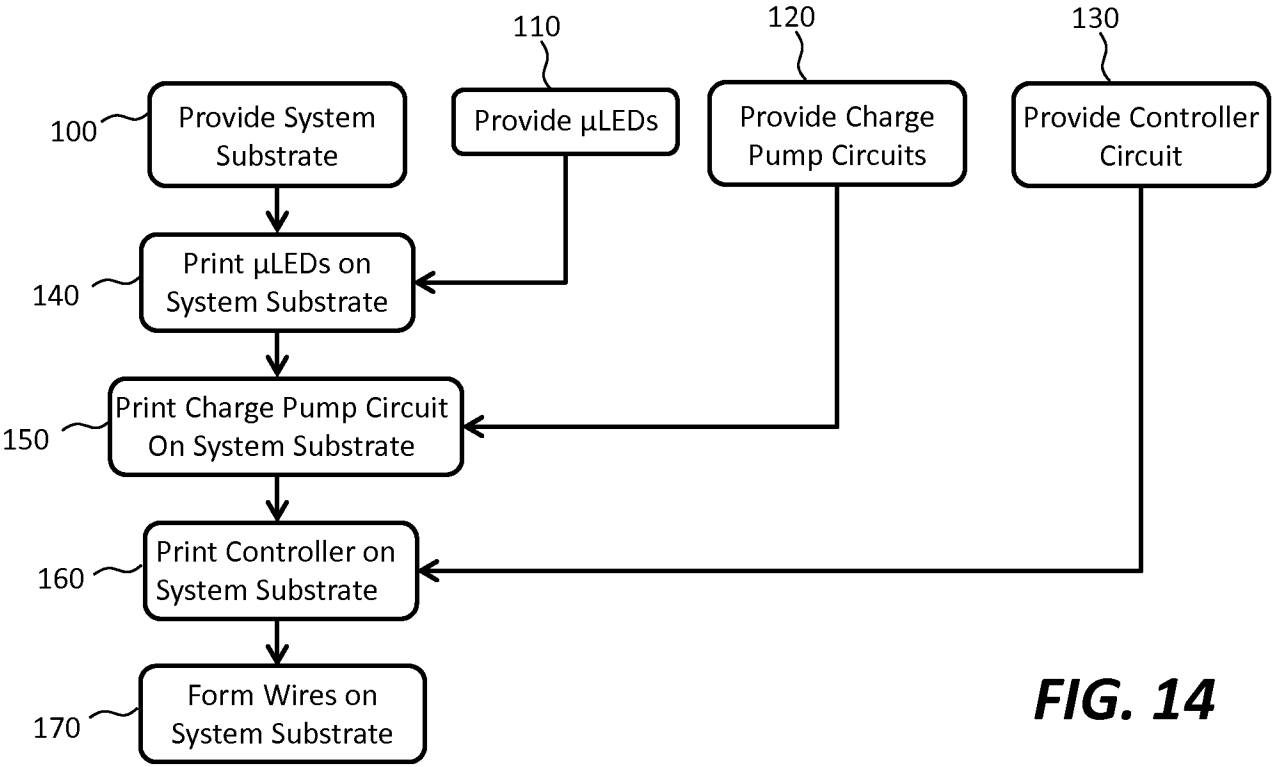
FIGS. 14-15 are flow charts illustrating methods of the present invention.

Various embodiments of the present invention can be made using photolithographic and printed-circuit board construction methods. Micro transfer printing methods can provide and locate one or more integrated circuits including the sub-elements 30, the charge-pump circuits 40, or the control circuits 60. For a discussion of micro-transfer printing techniques see, U.S. Pat. Nos. 8,722,458, 7,622,367 and 8,506,867, each of which is hereby incorporated by reference. Referring to FIG. 14 in a method of the present invention, a system substrate 10 is provided in step 100. System substrates can include a variety of materials such as glass, plastic, or metal, and can be rigid or flexible. Before, after, or at the same time, sub-elements 30 making up the electronic elements 20, for example micro LEDs, are provided on a wafer, for example a semiconductor wafer in or on which they are made in step 110. The sub-elements 30 can come from a variety of sources and materials, for example different semiconductor materials useful in making different micro LEDs that emit different colors of light, or from a common source. Likewise, charge-pump circuits 40 are provided in step 120 and control circuits 60 are provided in step 130, for example as integrated circuits in semiconductor wafers that can be the same as one of the sub-element 30 semiconductor wafers, or can be different wafers. Electronic sub-elements 30, such as micro-LEDs, charge-pump circuits 40, and control circuits 60 can all be made using integrated circuit or thin-film materials and methods.

The sub-elements 30, for example micro-LEDs, are located on the system substrate 10 in step 140, for example by micro transfer printing from a separate native substrate on which the micro-LEDs are formed onto the non-native system substrate 10. Alternatively, the sub-elements 30 are located on the system substrate 10 using pick-and-place methods, fluidic self-assembly, or other methods. In a different process, the sub-elements 30 are formed on the system substrate 10, or on layers formed on the system substrate 10, such as thin-film semiconductor layers. Similarly, the charge-pump circuits 40 are located or formed on the system substrate 10 in step 150 and the control circuits 60 are located or formed on the system substrate 10 in step 160, using one or more of these methods. Interconnecting electrically conductive wires are formed in step 170 to electrically connect the sub-elements 30, the charge-pump circuits 40, and the control circuits 60, for example using photolithographic or printed-circuit board methods, so that they can electrically operate together, for example under the control of an external controller (not shown).

Figure 15:
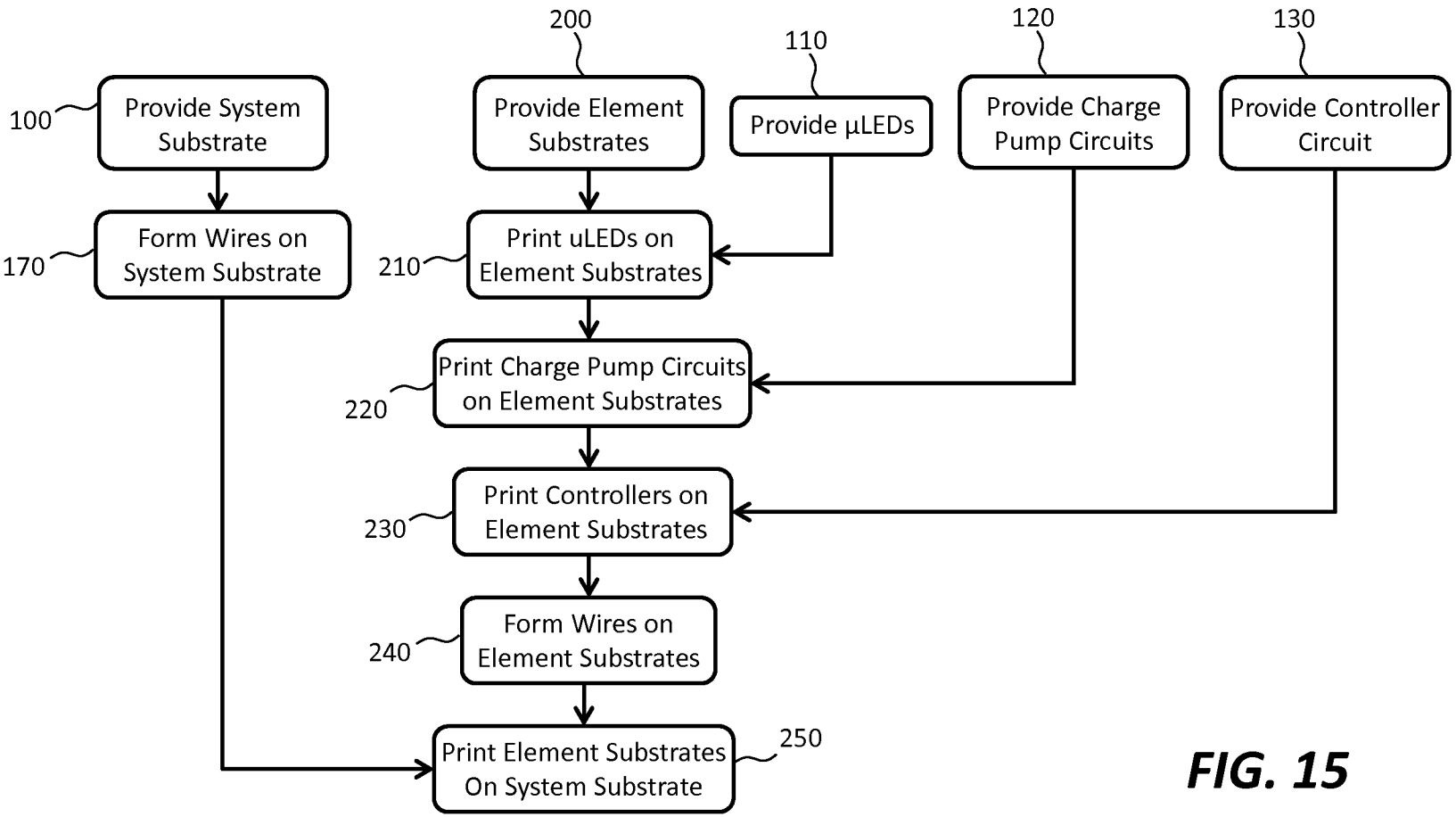

Referring to FIG. 15 in an alternative method of the present invention, the system substrate 10, sub-elements 30 such as micro-LEDs, charge-pump circuits 40, and control circuits 60 are provided as described above in steps 100, 110, 120, and 130. Element substrates 14, for example made of glass, plastic, or metal are provided in step 200. The element substrates 14 can include the same materials and employ the same processing methods as the system substrate 10, or different ones. Electrically interconnecting wires can be formed on the system substrate 10 in step 170. The sub-elements 30, such as micro-LEDs, are located on the element substrates 14 rather than on the system substrate 10 (as in FIG. 14) in step 210 using similar or different methods, such as micro-transfer printing. Likewise, the charge-pump circuits 40 and control circuits 60 are located on the element substrates 14 in steps 220 and 230 using similar or different methods, such as micro-transfer printing. In step 240, wires are formed on the elements substrates 14 to electrically interconnect the integrated circuits, for example the sub-elements 30, the charge-pump circuits 40, and the control circuits 60. In step 250, the element substrates 14 are located on the system substrate 10, for example by plugging tiles into connectors or soldering the element substrates 14 to the system substrate 10. Additional wires could be added if desired to complete the distributed charge-pump power-supply system 5.

In the methods illustrated in both FIGS. 14 and 15, the electrical interconnections on the system substrate 10 or the element substrates 14 can be made before or after, or both, the sub-elements 30, the charge-pump circuits 40, or the control circuits 60 are located or formed on their respective substrates. Although the method of FIG. 14 illustrates all of the sub-elements 30, the charge-pump circuits 40, and the control circuits 60 on the system substrate 10 and the method of FIG. 15 illustrates all of the sub-elements 30, the charge-pump circuits 40, and the control circuits 60 on the element substrate 14, in other embodiments some but not all of the sub-elements 30, the charge-pump circuits 40, or the control circuits 60 can be located or formed on the system substrate 10 and others but not all of the sub-elements 30, the charge-pump circuits 40, or the control circuits 60 can be located or formed on the element substrates 14.

In operation, an external controller (not shown) provides power to the charge-pump circuit 40 and control signals to the electronic elements 20 or the control circuit 60. The charge-pump circuit 40 provides power at different voltages to the different sub-elements 30 of the electronic elements 20. The different sub-elements 30 respond to the power provided by the charge-pump circuit 40 and the control signals provided by the external controller or the control circuit 60 and operate as designed, for example to emit light at the time and in the amount specified by the control signals.

As is understood by those skilled in the art, the terms "over" and "under" are relative terms and can be interchanged in reference to different orientations of the layers, elements, and substrates included in the present invention. For example, a first layer on a second layer, in some implementations means a first layer directly on and in contact with a second layer. In other implementations a first layer on a second layer includes a first layer and a second layer with another layer therebetween.

Having described certain implementations of embodiments, it will now become apparent to one of skill in the art that other implementations incorporating the concepts of the disclosure may be used. Therefore, the disclosure should not be limited to certain implementations, but rather should be limited only by the spirit and scope of the following claims.

Throughout the description, where apparatus and systems are described as having, including, or comprising specific components, or where processes and methods are described as having, including, or comprising specific steps, it is contemplated that, additionally, there are apparatus, and systems of the disclosed technology that consist essentially of, or consist of, the recited components, and that there are processes and methods according to the disclosed technology that consist essentially of, or consist of, the recited processing steps.

It should be understood that the order of steps or order for performing certain action is immaterial so long as the disclosed technology remains operable. Moreover, two or more steps or actions in some circumstances can be conducted simultaneously. The invention has been described in detail with particular reference to certain embodiments thereof, but it will be understood that variations and modifications can be effected within the spirit and scope of the invention.

PARTS LIST

R1 resistor
R2 resistor
T1 transistor
T2 transistor
5 distributed charge-pump power-supply system
10 system substrate
12 system substrate surface
14 element substrate
20 electronic element
30 sub-element
30A sub-element
30B sub-element
30C sub-element
40 charge-pump circuit
42 first charge pump
44 second charge pump
50 group
60 control circuit
100 provide system substrate step
110 provide μLEDs step
120 provide charge-pump circuit step
130 provide controller circuit step
140 print μLEDs on system substrate step
150 print charge pumps on system substrate step
160 print controller on system substrate step
170 form wires on system substrate step
200 provide element substrates step
210 print μLEDs on element substrate step
220 print charge pump circuits on element substrate step
230 print controller on element substrate step
240 form wires on system substrate step
250 form wires on system substrate step

The invention claimed is:

1. A distributed charge-pump power-supply system, comprising:

a system substrate;

a plurality of separate electronic elements spatially distributed over the system substrate, each electronic element including a first sub-element requiring a first voltage connection supplying operating electrical power at a first voltage and a second sub-element requiring a second voltage connection supplying operating electrical power at a second voltage, the first voltage different from the second voltage; and a plurality of separate charge-pump circuits spatially distributed over the system substrate, each charge-pump circuit having a common charge-pump power supply connection and providing the first voltage connection supplying operating electrical power at the first voltage and the second voltage connection supplying operating electrical power at the second voltage, wherein the plurality of electronic elements are arranged in groups and, for each of the groups, the first and second voltage connections for each electronic element in the group are provided by a charge-pump circuit of the plurality of charge-pump circuits.

2. The distributed charge-pump power-supply system of claim 1, wherein the sub-elements are inorganic light-emitting diodes.

3. The distributed charge-pump power-supply system of claim 1, wherein the electronic elements are multi-color pixels and the sub-elements are different light emitters each emitting a different color of light.

4. The distributed charge-pump power-supply system of claim 1, wherein each electronic element further comprises a third sub-element requiring a third voltage connection supplying operating electrical power at a third voltage, the third voltage different from the first voltage and different from the second voltage.

5. The distributed charge-pump power-supply system of claim 4, wherein the first, second, and third sub-elements are different inorganic light-emitting diodes that emit light of different colors.

6. The distributed charge-pump power-supply system of claim 5, wherein the different colors are red, green, and blue.

7. The distributed charge-pump power-supply system of claim 1, wherein one or more of the groups comprise only one electronic element.

8. The distributed charge-pump power-supply system of claim 1, wherein one or more of the groups comprise two or more of the plurality of electronic elements.

9. The distributed charge-pump power-supply system of claim 1, comprising a control circuit for controlling the electronic element and wherein the control circuit is provided in a first integrated circuit and the charge-pump circuit is at least partly provided in the first integrated circuit.

10. The distributed charge-pump power-supply system of claim 1, comprising a control circuit for controlling the electronic element and wherein the control circuit is provided in a first integrated circuit and the charge-pump circuit is at least partly provided in a second integrated circuit that is different from the first integrated circuit.

11. The distributed charge-pump power-supply system of claim 1, wherein the electronic element is provided in a single integrated circuit.

12. The distributed charge-pump power-supply system of claim 1, wherein two or more sub-elements of a common electronic element are provided in separate integrated circuits.

13. The distributed charge-pump power-supply system of claim 1, wherein the charge-pump circuit is provided in an integrated circuit.

14. The distributed charge-pump power-supply system of claim 1, wherein the charge-pump circuit is provided in two or more integrated circuits.

15. The distributed charge-pump power-supply system of claim 14, wherein the second integrated circuits are spatially separated over the system substrate.

16. The distributed charge-pump power-supply system of claim 1, wherein the electronic elements are provided on element substrates separate from the system substrate.

17. The distributed charge-pump power-supply system of claim 1, wherein the charge-pump circuit is spatially located between the sub-elements that receive power from the charge-pump circuit or is spatially located between the electronic elements in a group of two or more electronic elements that receive power from the charge-pump circuit.

18. A display having a distributed charge-pump power-supply system, comprising:

a system substrate;

a plurality of multi-color pixels spatially distributed over the system substrate, each multi-color pixel including a first inorganic light-emitting diode requiring a first voltage connection supplying operating electrical power at a first voltage and a second inorganic light-emitting diode requiring a second voltage connection supplying operating electrical power at a second voltage, the first voltage different from the second voltage; and a plurality of separate charge-pump circuits spatially distributed over the system substrate, each charge-pump circuit having a common charge-pump power supply connection and providing the first voltage connection supplying operating electrical power at the first voltage and the second voltage connection supplying operating electrical power at the second voltage, wherein the first and second inorganic light-emitting diodes of the multi-color pixels are arranged in groups and, for each of the groups, the first and second voltage connections for each first and second inorganic light-emitting diodes in the group are provided by a charge-pump circuit of the plurality of charge-pump circuits.

19. The display of claim 18, wherein any of the inorganic light-emitting diodes and the charge-pump circuit are provided on element substrates separate from the system substrate and are tiled over the system substrate to form an array of the inorganic light-emitting diodes.

20. The display of claim 18, wherein each multi-color pixel comprises a third inorganic light-emitting diode requiring a third voltage connection supplying operating electrical power at a third voltage, the third voltage different from the first voltage and the second voltage; and each charge-pump circuit providing the third voltage connection supplying operating electrical power at the third voltage, wherein the first, second, and third inorganic light-emitting diodes of the multi-color pixels are arranged in groups and the first, second, and third voltage connections for each group are provided by a charge-pump circuit of the plurality of charge-pump circuits.

* * * * *